United States Patent [19]

Kawasaki et al.

[11] Patent Number: 5,011,000

[45] Date of Patent: Apr. 30, 1991

[54] BOBBIN CARRIER IN SPINNING MACHINE

[75] Inventors: Yoshio Kawasaki, Shimada; Tatsutake Horibe, Fujieda; Takayuki Morita, Kariya; Haruyoshi Nakamura, Kariya; Kengo Ohashi, Kariya; Tsutomu Miyazaki, Kariya, all of Japan

[73] Assignees: Kabushiki Kaisha Toyda Jidoshokki Seisakusho, Aichi; Nisshinbo Industries, Inc., Tokyo, both of Japan

[21] Appl. No.: 368,023

[22] Filed: Jun. 19, 1989

[30] Foreign Application Priority Data

Jun. 21, 1988 [JP] Japan ..... 63-152662

[51] Int. Cl.[5] ..... B65G 29/00

[52] U.S. Cl. ..... 198/465.1; 198/803.12; 242/35.5 A

[58] Field of Search ..... 198/465.1, 803.01, 803.12, 198/487.1; 242/35.5 A

[56] References Cited

U.S. PATENT DOCUMENTS

| | | | |
|---|---|---|---|
| 4,144,961 | 3/1979 | Kasahara et al. | 198/465.1 |
| 4,667,807 | 5/1987 | Sanno | 198/803.12 X |
| 4,742,967 | 5/1988 | Sanno et al. | 242/35.5 A |
| 4,776,468 | 10/1988 | Kirrake | 198/803.12 X |
| 4,784,255 | 11/1988 | Uchida | 198/465.1 X |

FOREIGN PATENT DOCUMENTS

| | | |
|---|---|---|
| 60-52475 | 3/1985 | Japan . |
| 62-180881 | 8/1987 | Japan . |
| 62-180882 | 8/1987 | Japan . |

*Primary Examiner*—Robert P. Olszewski
*Assistant Examiner*—Cheryl L. Gastineau
*Attorney, Agent, or Firm*—Brooks Haidt Haffner & Delahunty

[57] ABSTRACT

A bobbin carrier in a spinning machine for carrying out full-bobbins from one of a pair of carriers and carrying in empty bobbins to the other of the carriers through peg trays by a full-bobbins-carrying conveyor and an empty-bobbin-carrying conveyor to a plurality of spinning machines arranged in parallel with one another. An endless belt is provided over both of the carriers and the full-bobbins-carrying conveyor and the empty-bobbin-carrying conveyor, and pulleys guide the belt, further a motor is operatively connected to the belt to drive the belt. A pair of linear guiding members are arranged so as to extend along the belt and gasp pegs of peg trays. The belt carries the peg trays with grasping the trays elastically with pressure in cooperation with the guiding members. A full-bobbin-introducing portion is provided in the full-bobbin-carrying conveyor and allows giving and receiving of the peg trays from the belt to the full-bobbin-carrying conveyor. An empty-bobbin-discharging portion is provided in the empty-bobbin-carrying conveyor and allows giving and receiving of the peg trays from the empty-bobbin-carrying conveyor to the belt.

10 Claims, 9 Drawing Sheets

BOBBIN CARRIER IN SPINNING MACHINE

FIELD OF THE INVENTION

This invention relates to a bobbin carrier in a spinning machine for carrying doffed full bobbins to a winder process and supplying a spinning machine with empty bobbins having their yarn rewound in the winder process in a spinning machine such as a ring fine spinning machine and a ring twister.

DESCRIPTION OF THE RELATED ART

Generally, yarn produced by a fine spinning machine particularly by a ring fine spinning machine is rewound by a winder into a package with a suitable size and shape for a post-process. For laborsaving and improvement of productivity, there are proposed various combined fine spinning machines and winders in which fine spinning machines and winders are connected directly through a bobbin-carrying route so as to carry yarns taken up on bobbins (full bobbins) doffed by the fine spinning machines to the winders and supply the fine spinning machines with empty bobbins having been used by the winders. As such a combined fine spinning machine and winder, in Japanese Laid-Open Patent Publication No. 52475/1985, as shown in FIG. 11, there is disclosed an apparatus in which a main carrying route 83 in the form of a closed loop is provided at a side of a plurality of winders 81 and fine spinning machines 82 arranged in parallel with one another, and further the winders 81 and the fine spinning machines 82 are respectively connected with the main carrying route 83 through selectors 84, 85 and carrying routes 86*a*, 86*b*, 87*a*, 87*b*. In this apparatus, full bobbins doffed from the respective fine spinning machines 82 are carried on the carrying routes 87*b* and the main carrying route 83 and supplied into the winders 81 through the selectors 84 and the carrying routes 86*a*. On the other hand, empty bobbins having been rewound by the winders 81 are carried on the carrying routes 86*b* and the main carrying route 83, and returned to the respective fine spinning machines 82 through the selectors 85 and the carrying routes 87*a*.

While, in Japanese Laid-Open Patent Publication No. 180881/1987, as shown in FIG. 12, there is disclosed an apparatus in which are provided above and below on a ceiling a full-bobbin-carrying line 88 for carrying full bobbins F doffed by fine spinning machines 82 over the end portions of a group of the fine spinning machines 82 to a winder process, and an empty-bobbin-carrying line 89 for carrying empty bobbins E having been used at the winder process to a fine spinning process, and the fine spinning machines 82 and both of the carrying lines 88, 89 are connected through a movable vertical conveyor 90, so that the full bobbins F doffed at the fine spinning machines 82 are carried into the full-wound bobbin carrying line 88 and the empty bobbins on the empty-bobbin-carrying line 89 are supplied into the fine spinning machines 82.

While, in a usual vertical conveyor as disclosed in Japanese Laid-Open Patent Publication No. 180882/1987, as shown in FIG. 13, when the radius of curvature R of a lower bend 94*a* of a conveyor frame 94 is small, the full bobbins interfere with one another. Thus, the radius of curvature R can not be so small, so that a relatively wide space must be required for setting up the conveyor. In order to dissolve the inconvenience, there is proposed a bobbin carrier in which an endless transmission belt 91 is drivably and stretchedly provided along a desired passage through a belt guide and guiding pulleys, and two lines of guides 93 sliding on the top face of peg trays 92 are provided along the transmission belt 91, so that the peg trays 92 are moved with the transmission belt 91 with being elastically grasped with pressure by the transmission belt 91 and the guides 93. In this apparatus, posture of empty bobbins E or full bobbins F mounted on pegs 92*a* can be freely changed by arranging the guides 93 in a twisted state to the transmission belt 91 as shown in FIG. 14.

In the apparatus disclosed in Japanese Laid-Open Patent Publication No. 52475/1985, since its carrying route is set up on a floor, the carrying routes tend to cause problems in passing of workers or running of automatic machines. While, in the apparatus disclosed in Japanese Laid-Open Patent Publication No. 18081/1987, since the vertical conveyor 90 is stopped at positions respectively corresponding to the bobbin-carrying routes arranged on the sides of the respective fine spinning machines 82, and carries out the full bobbins F doffed at the fine spinning machines, and then supplies the empty bobbins E from the empty-bobbin-carrying line 89 to the fine spinning machines 82, thus it takes relatively much time to carry out the full bobbins F and then carry in the empty bobbins E between the fine spinning machines and the carrying lines 88, 89. There can be also another device in which the carrying route for connecting the winder process and the fine spinning process is provided on a ceiling, and vertical conveyors connected with the carrying route are provided at the end portions of the sides of respective fine spinning machine frames. However, it requires a high cost to provide the vertical conveyors independently at the sides of the respective fine spinning machines.

SUMMARY OF THE INVENTION

It is an object of this invention to provide a bobbin carrier in a spinning machine which can reduce the cost of equipment and shorten the work time.

In order to achieve the object, this invention provides a bobbin carrier in a spinning machine for carrying out full bobbins from one of a pair of carriers provided at the spinning machine and carrying in empty bobbins to the other of the carriers through peg trays comprising trays and pegs each projecting from one face of the trays by a full-bobbin-carrying conveyor and an empty-bobbin-carrying conveyor respectively extending substantially perpendicularly to the longitudinal direction of a plurality of spinning machines arranged in parallel with one another in the vicinity of one end in the longitudinal direction of the spinning machines. The bobbin carrier comprises an endless belt provided over both the carriers and the full-bobbin-carrying conveyor and the empty-bobbin-carrying conveyor, a guiding means for guiding and supporting the belt, a driving means operatively connected to the belt for driving the belt, a pair of linear guiding members, disposed so as to extend along the belt, for sandwiching the pegs of the peg trays, the belt carrying the peg trays while sandwiching the trays elastically with pressure in cooperation with the guiding members, a full-bobbin-introducing portion provided in the full-bobbin-carrying conveyor for allowing giving and receiving of the peg trays from the belt to the full-bobbin-carrying conveyor, and an empty-bobbin-discharging portion provided in the empty-bobbin-carrying conveyor for allowing giving and receiving the peg trays from the empty-bobbin-carrying conveyor to the belt.

These and other objects of this invention will be apparent by understanding embodiments which will be described hereinafter, and will be clearly set forth in claims hereto appended, and other advantages not referred to herein will be easily thought out by those versed in the art by using this invention.

BRIEF DESCRIPTION OF THE DRAWINGS

FIG. 1 shows a schematic perspective view of a bobbin carrier,

FIG. 2 shows a schematic plan view of the same,

FIG. 3(*a*) shows a partly perspective view of a full-bobbin-giving and receiving portion, FIG. 3(*b*) shows a partly perspective view of an empty-bobbin-giving and receiving portion, FIG. 4 shows a partly perspective view of a full-bobbin-introducing portion, FIG. 5(*a*) shows a partial plan view of an empty-bobbin-discharging portion, FIG. 5(*b*) shows a cross-sectional view taken on line A—A of FIG. 5(*a*), FIG. 6(*a*) shows a partial side view for explaining arrangement between guiding members and a belt, and FIG. 6(*b*) shows a cross-sectional view taken on line B—B of FIG. 6(*a*);

FIG. 7 shows a schematic plan view of bobbin carrier,

FIG. 8 shows a partial plan view of a full-bobbin-introducing portion, and

FIG. 9 shows a cross-sectional view taken on line C—C of FIG. 8;

DESCRIPTION OF THE PREFERRED EMBODIMENTS

Embodiment 1

Figure 1:
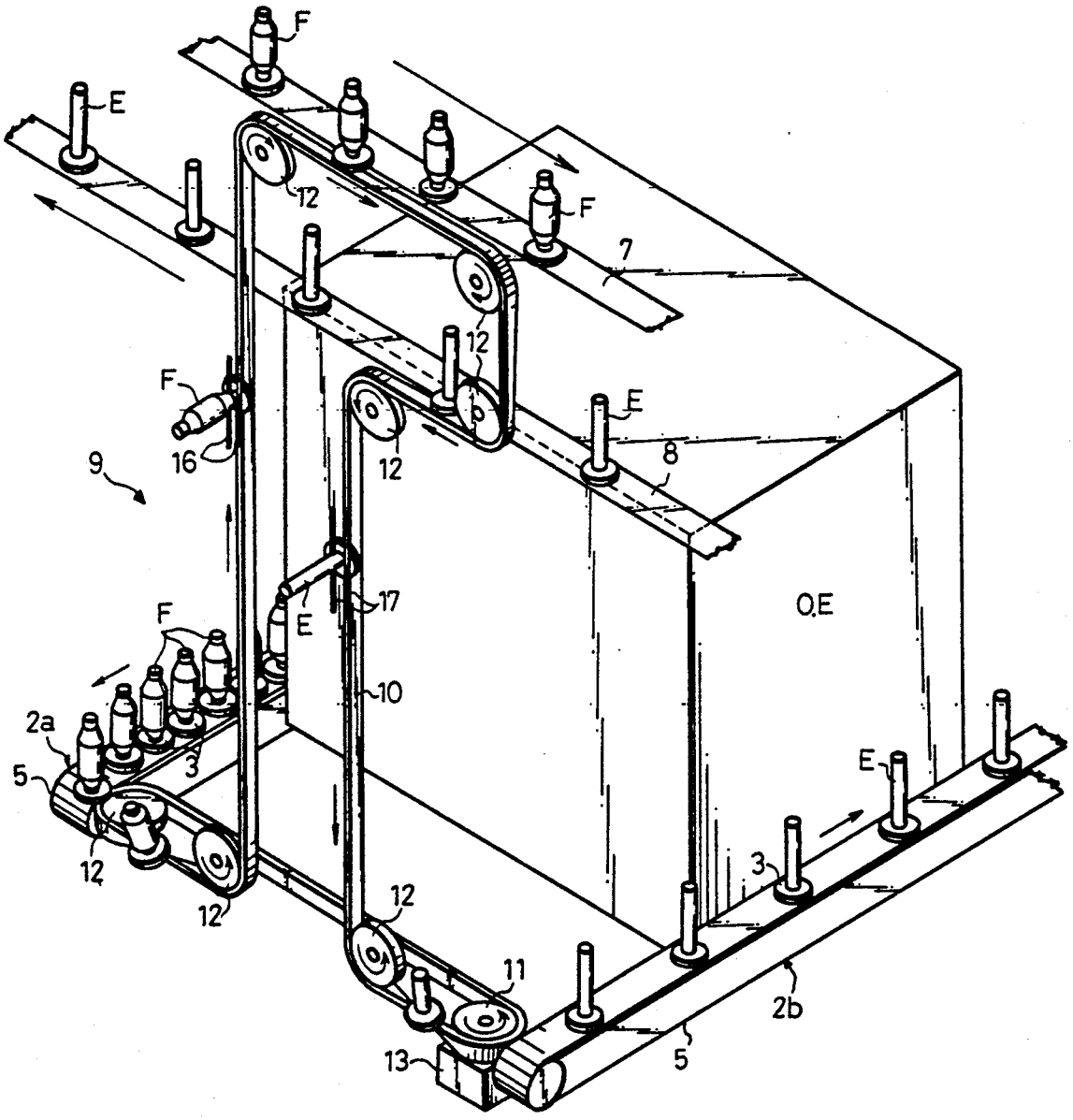
FIGS. 1 to 6 show a first embodiment of this invention.
Figure 3B:
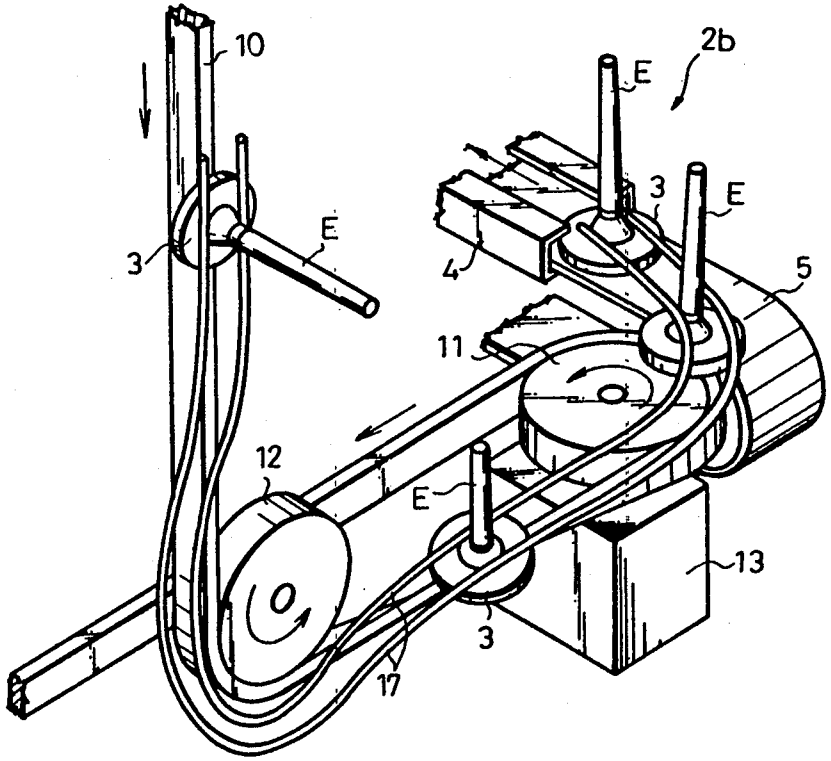
Figure 2:
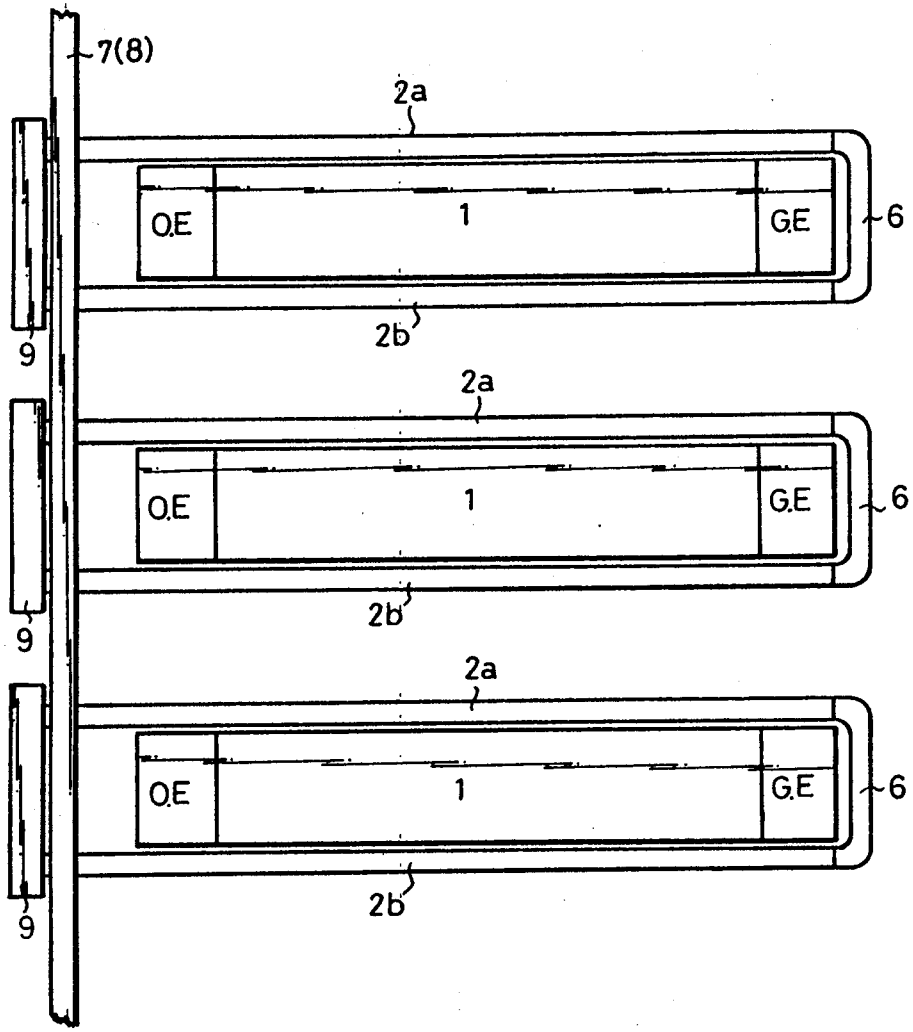
Figure 3A:
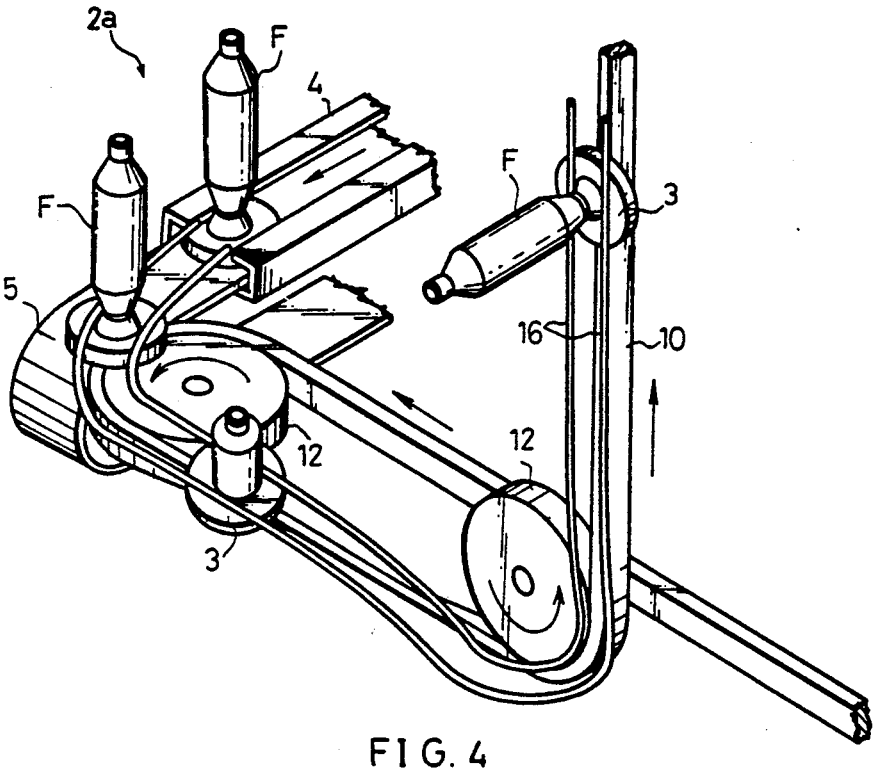

Hereinafter a first embodiment for embodying this invention will be described in accordance with FIGS. 1 to 6. As shown in FIG. 2, a plurality of fine spinning machine frames 1 are arranged in parallel with one another, and carriers 2*a*, 2*b* extend along the sides in the longitudinal direction of the respective frames 1. Each pair of the carriers 2*a*, 2*b* are composed of a guide rail 4 (as shown in FIGS. 3(*a*), 3(*b*)) for guiding peg trays 3 respectively having pegs 3*a* projecting from the top faces of trays 3*b* and a belt conveyor 5 for carrying the peg trays 3 so as to carry empty bobbins E and full bobbins F by using the peg trays 3. Moreover, the carriers 2*a*, 2*b* are connected with each other through a connecting rail 6 at a gear end GE side of each of the fine spinning machine frames 1 so that the peg trays 3 are carried from the carrier 2*b* into the carrier 2*a*. While, as shown in FIGS. 1 and 2, a full-wound-bobbin-carrying conveyor 7 and an empty-bobbin-carrying conveyor 8 respectively linked with a winder process are provided above and below in parallel with each other to extend perpendicularly to the longitudinal direction of the fine spinning machine frames 1 at positions corresponding to end portions of the carriers 2*a*, 2*b* above respective out end OE sides of the fine spinning machine frames 1. The bobbin-carrying directions of the bobbin-carrying conveyors 7, 8 are opposite to each other as shown by arrows in FIG. 1. At each end portion of the out end OE sides of the fine spinning machine frames 1, there is arranged a bobbin carrier 9 for giving the full bobbins F between the carrier 2*a* and the full-bobbin-carrying conveyor 7 and receiving the empty bobbins between the carrier 2*b* and the empty-bobbin-carrying conveyor 8. In the bobbin carrier 9, a belt 10 for carrying peg trays 3 is arranged over a driving pulley 11 and a plurality of guiding pulleys 12 so as to have portions where the belt 10 respectively runs in the vicinity of and corresponding to the end portions of the carriers 2*a*, 2*b* at a substantially equal height in a horizontal direction perpendicular to the carriers 2*a*, 2*b*, portions where it runs between the carriers 2*a*, 2*b* up to a substantially equal height and vertically to the full-bobbin-carrying conveyor 7, a portion where it runs in the vicinity of and along the full-bobbin-carrying conveyor 7 at substantially equal height and parallel thereto, a portion where it runs in the vicinity of and along the empty-bobbin-carrying conveyor 8 at a substantially equal height and parallel thereto, and portions where it runs vertically downward from a substantially equal height to the empty-bobbin-carrying conveyor 8 to a substantially equal height to the carrying conveyor 7 and the empty-bobbin-carrying conveyor 8 are driven by a motor 13 in the same directions as respective carrying directions of the bobbin-carrying conveyors 7, 8.

Figure 4:
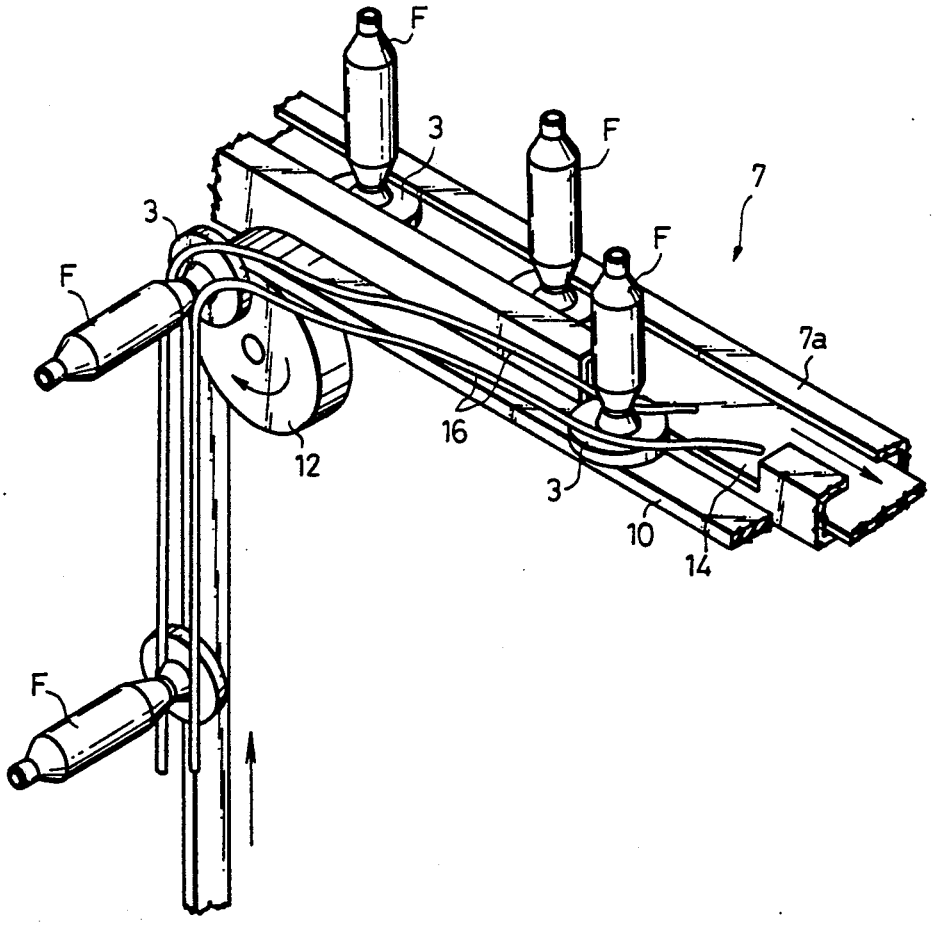
Figure 5A:
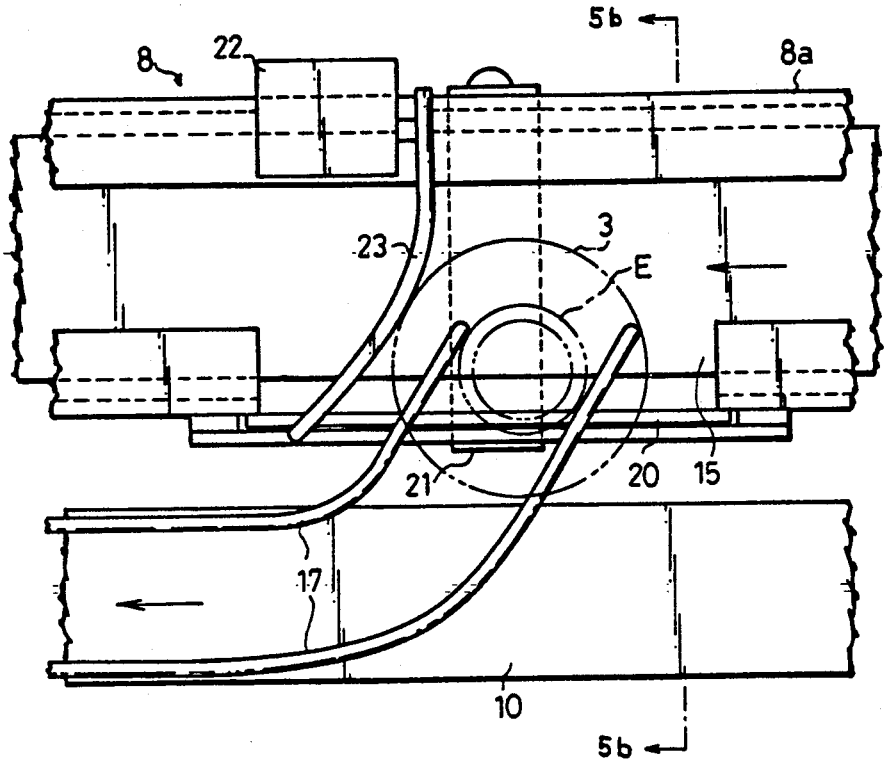
Figure 5B:
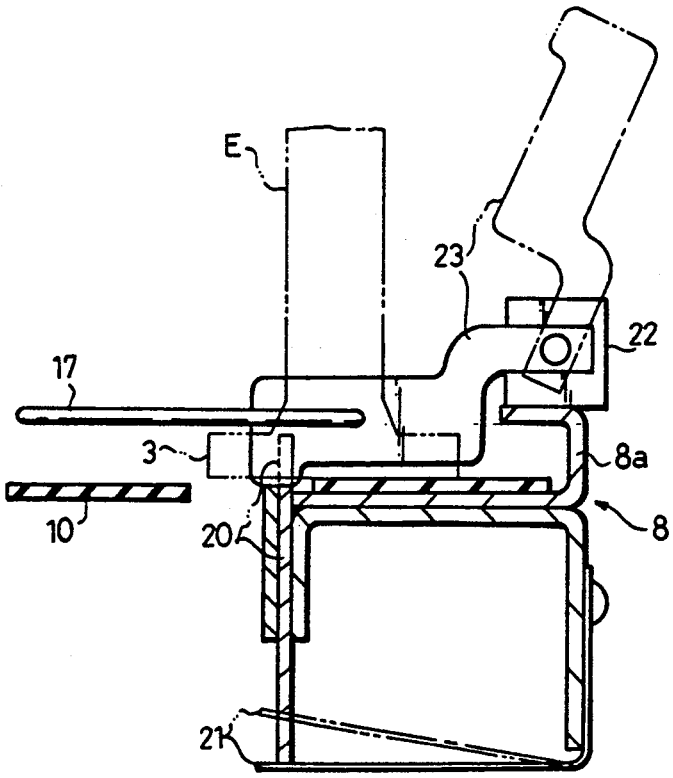

As shown in FIGS. 4 and 5, there are arranged a full-bobbin-introducing portion 14 at a portion in the full-bobbin-carrying conveyor 7 corresponding to the portion where the belt 10 runs parallel to the conveyor 7, and an empty-bobbin discharging portion 15 at a portion in the empty-bobbin carrying conveyor 8 corresponding to the portion where the belt 10 runs parallel to the conveyor 8. A pair of linear guiding members 16 are arranged along the running route of the belt 10 from a position corresponding to the end portion of the carrier 2*a* to a position corresponding to the full-bobbin-introducing portion 14 of the full-bobbin-carrying conveyor 7 so as to grasp trays 3*b* of peg trays 3 elastically with pressure in cooperation with the belt 10 while grasping pegs 3*a* of the peg trays 3. While, a pair of linear guiding members 17 are arranged along the running route of the belt 10 from a position corresponding to the end portion of the other carrier 2*b* to a position corresponding to the empty-bobbin-discharging portion 15 of the empty-bobbin-carrying conveyor 8 so as to grasp the trays 3*b* of the peg trays 3 elastically with pressure in the same manner as mentioned above in cooperation with the belt 10.

Figure 6A:
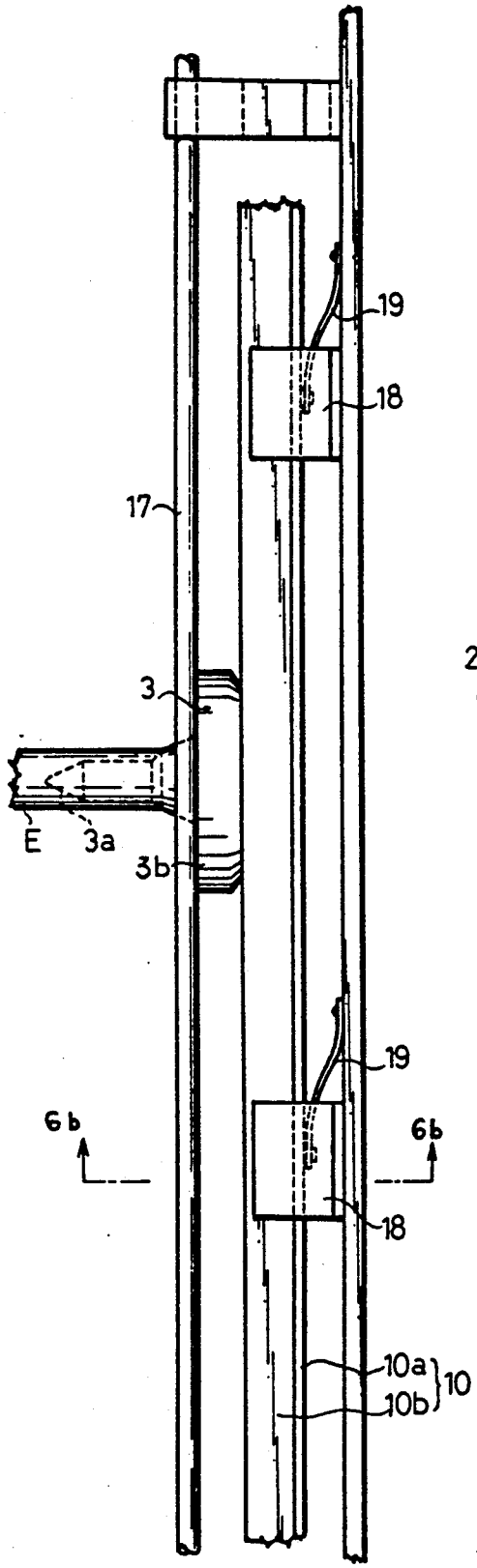
Figure 6B:
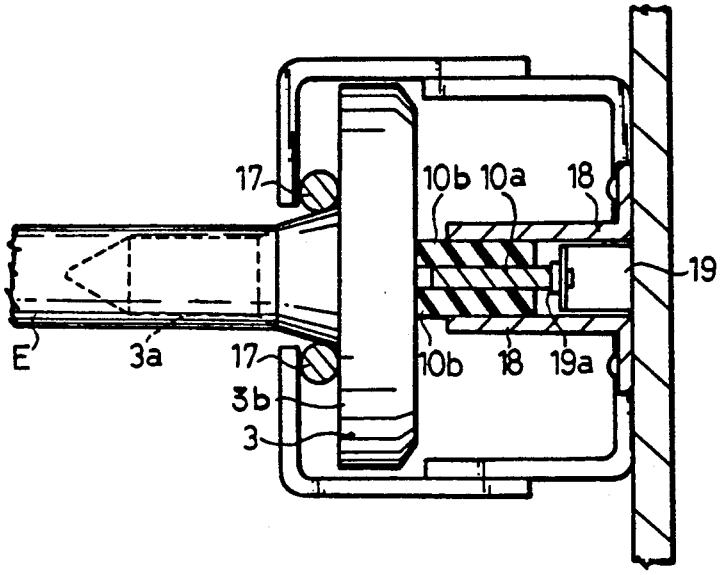

A flat belt composing the belt 10 comprises a sliding core band 10*a* with low frictional properties and a rubber layer 10*b* with high frictional properties as shown in FIGS. 6(*a*), 6(*b*), and has a laminated composition in which an end of the sliding core band 10*a* projects out of the rubber layer 10*b*. Each peg tray 3 moves with the belt 10 with its bottom face being in pressured contact with the rubber layer 10*b* of the belt 10. In a place where the belt 10 runs vertically, the peg trays 3 move in contact with the rubber layer 10*b* of the belt 10 at the opposite side to the sliding core band 10*a*, and guiding segments 18 are arranged at predetermined intervals for guiding the belt 10 while grasping both the faces of the belt 10, further plate springs 19 are arranged at predetermined intervals for urging the belt 10 in contact with the sliding core band 10*a* in the width direction of the belt 10, that is, in the direction to the guiding members 16, 17. The plate springs 19 do not contact with the sliding core band 10*a* directly, but contact portions 19*a* formed of a member having wear resistance such as ceramics contact with the sliding core band 10*a*. The urging direction of the plate springs 19 is the width direction of the belt 10. However, since the width of the guiding pulleys 12 is wider than that of the belt 10, so the belt 10 is never off the guiding pulleys 12.

End portions of the guiding members 16, 17 corresponding to the carriers 2*a*, 2*b* respectively extend up to above the guide rail 4 of the carriers 2*a*, 2*b* as shown in FIGS. 3(*a*), 3(*b*), so that the giving and receiving of the peg trays 3 between the carriers 2*a*, 2*b* and the bobbin carrier 9 can be carried out smoothly. In a place corresponding to the full-bobbin-introducing portion 14, a side corresponding to the bobbin carrier 9 of a guiding rail 7*a* of the full-bobbin-carrying conveyor 7 is notched as shown in FIG. 4 on purpose to make it possible to introduce the peg trays 3 onto the full-bobbin-carrying conveyor 7 from the belt 10, and the notched portion is a little higher than the top face of the full-bobbin-carrying conveyor 7. Moreover, the belt 10 is so arranged as to be a little higher than the top face of the full-bobbin-carrying conveyor 7 at the position corresponding to the full-wound bobbin-introducing portion 14, thus the peg trays 3 can be moved smoothly from the belt 10 onto the full-bobbin-carrying conveyor 7, and further the peg trays 3 once moved on the full-bobbin-carrying conveyor 7 never move outside from the full-bobbin-introducing portion 14. While, in a place corresponding to the empty-bobbin-discharging portion 15, a side corresponding to each the bobbin carrier 9 of a guiding rail 8*a* of the empty-bobbin-carrying conveyor 8 is notched as shown in FIGS. 5(*a*), 5(*b*) to give an opening to the side. In a position corresponding to the notched portion, a controlling segment 20 is provided slidably in the vertical direction, and usually the segment 20 is situated a position designated by a dotted line in FIG. 5(*b*) with the bottom end thereof being in contact with a plate spring 21 fixed at the guiding rail 8*a* so as to prevent the peg trays 3 from moving outside from the notched portion. On a place of the guiding rail 8*a* corresponding to the notched portion a rotary solenoid 22 is fixed, and on a driving shaft thereof is fixed a controlling member 23 for controlling the moving direction of the peg trays 3 while being moved between a working position where the member 23 can engage the outer surface of the peg trays 3 and a waiting position where the engagement is impossible by being pivoted in a plane crossing the moving direction of the empty-bobbin-carrying conveyor 8, and when moved at the working position designated by a solid line in FIG. 5(*b*), it also urges the controlling segment 20 downward.

Hereinafter, operation of the apparatus composed in the manner as mentioned above will be described. The fine spinning machine frames 1 are stopped with the bobbins fully wound and then the empty bobbins E on the peg trays 3 and the full bobbins F on spindles previously prepared on the carriers 2*a*, 2*b* are exchanged by a bobbin-exchanging apparatus (not shown). When the exchange is completed, it becomes possible to carry out the full bobbins F and carry in the empty bobbins E. In this state, the carriers 2*a*, 2*b* and the bobbin carriers 9 are respectively operated, and the carrying out of the full bobbins F and the carrying in of the empty bobbins E in the fine spinning machine frames 1 are started. Before the operation of the bobbin carriers 9, the rotary solenoids 22 are operated respectively, and the controlling members 23 are arranged at the working positions engageable with the peg trays 3 on the empty-bobbin-carrying conveyor 8. By this operation, the controlling segments 20 are arranged respectively at working positions as shown in the solid line in FIG. 5(*b*), and further the moving direction of the peg trays 3 moving on the empty-bobbin-carrying conveyor 8 is controlled respectively by the controlling members 23 so that the peg trays 3 are discharged into the bobbin carriers 9 through the respective empty-bobbin-discharging portions 15. The carriers 2*a* are driven in the direction in which the peg trays 3 are carried to the respective out end OE sides, while the other carriers 2*b* are driven in the direction in which the peg trays 3 are carried to the respective gear end GE sides. Accordingly, the peg trays 3 on the other carriers 2*b* are carried into the carriers 2*a* through connecting rails 6. The peg trays 3 having the full bobbins F thereon on the carriers 2*a* are guided by the guiding members 16 and successively moved onto the belts 10 of the bobbin carriers 9 respectively, and the posture of the peg trays 3 is altered from the vertical state to the horizontal state by effect of the guiding members 16. In the portions where the belts 10 run in the vertical direction, the full bobbins F are moved while being held horizontally, and in the portions where the belts 10 run parallel to the full-bobbin-carrying conveyor 7, the posture of the full bobbins F is again altered into the vertical state. Since the end portions of the guiding members 16 extend up to above the full-bobbin-carrying conveyor 7 as shown in FIG. 4, the moving direction of the peg trays 3 moved with the belts 10 parallelly to the full-bobbin-carrying conveyor 7 is changed at the position corresponding to the full-bobbin-introducing portions 14, and thus the peg trays 3 are smoothly given onto the full-bobbin-carrying conveyor 7.

While, the moving direction of the peg trays 3 moved on the empty-bobbin-carrying conveyor 8 is controlled by the controlling members 23 at the empty-bobbin-discharging potions 15, and the peg trays 3 are received onto the belts 10 of the respective bobbin carriers 9. The posture of the peg trays 3 received onto the belts 10 with the posture of the empty bobbins E kept in the vertical state is altered into the horizontal state by effect of the guiding members 17. Then, the peg trays 3 are moved with the belts 10 over the position in which the belts 10 run vertically. Thereafter, the posture of the peg trays 3 is altered by the effect of the guiding members 17 so that the posture of the empty bobbins E is again in the vertical state before the peg trays 3 reach the position corresponding to the carriers 2*b*, and then the peg trays 3 are carried into the carriers 2*b*.

At the empty-bobbin-discharging portions 15, there are arranged respectively sensors (not shown) for detecting the number of the empty bobbins E carried into the respective bobbin carriers 9 from the empty-bobbin-carrying conveyor 8. When the number of the empty bobbins E counted based on the detected signals of the sensors reaches a predetermined number, the rotary solenoids 22 are respectively operated. Then, the controlling members 23 are moved to the waiting positions not engageable with the peg trays 3. By the above-mentioned operation, the controlling segments 20 are respectively returned to the positions as designated the dotted line in FIG. 5 (*b*), and the movement of the peg trays 3 to the outside of the empty-bobbin-carrying conveyor 8 is controlled, thus an excessive number of the empty bobbins E are never carried into the respective bobbin carriers 9. The peg trays 3 having the empty bobbins E thereon and carried into the carriers 2*b* through the respective bobbin carriers 9 are carried to the carriers 2*a* through the connecting rails 6. When the respective leading peg trays 3 reach predetermined positions of the out end OE sides of the carriers 2*a*, the movement of the peg trays 3 is controlled by the effect of stoppers (not shown), and the following peg trays 3 are successively arranged in front positions of spindle rails in contact with one another from the predetermined positions. While, at the gear end GE sides of the respective carriers 2*b*, there are arranged counters for counting the number of the empty bobbins E. When the number of the empty bobbins E to be carried into the carrier 2*a* reaches a predetermined number, stoppers arranged at the predetermined positions of the gear end GE sides of the respective carriers 2*b* are operated, and the movement of the peg trays 3 is controlled. Thus, the peg trays 3 having the empty bobbins E thereon are successively arranged corresponding to spindle arrays from the positions corresponding to the stoppers.

At the end portions of the respective carriers 2*a*, there are arranged full-bobbin-detecting devices (not shown) for counting the number of the full bobbins F carried into the respective bobbin carriers 9. Then, the respective motors 13 are stopped when a predetermined time has passed after the number reaches a predetermined number and when the discharge of the predetermined number of empty bobbins E from the respective empty-bobbin-discharging portions 15 has been completed, thus the carrying out of the full bobbins F and the carrying in of the empty bobbins E are completed. Since the carrying out of the full bobbins F and the carrying in of the empty bobbins E are performed at the same time as mentioned above, the working time can be shortened.

Embodiment 2

Figure 8:
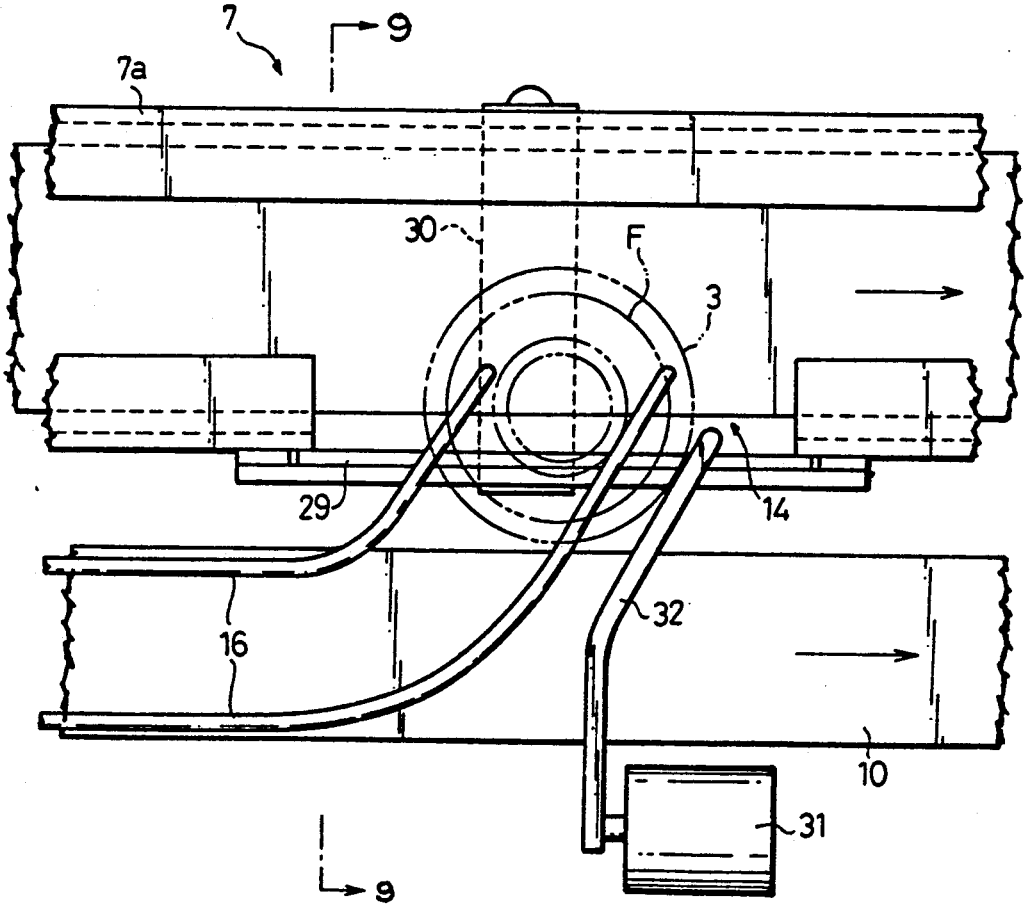
Figure 9:
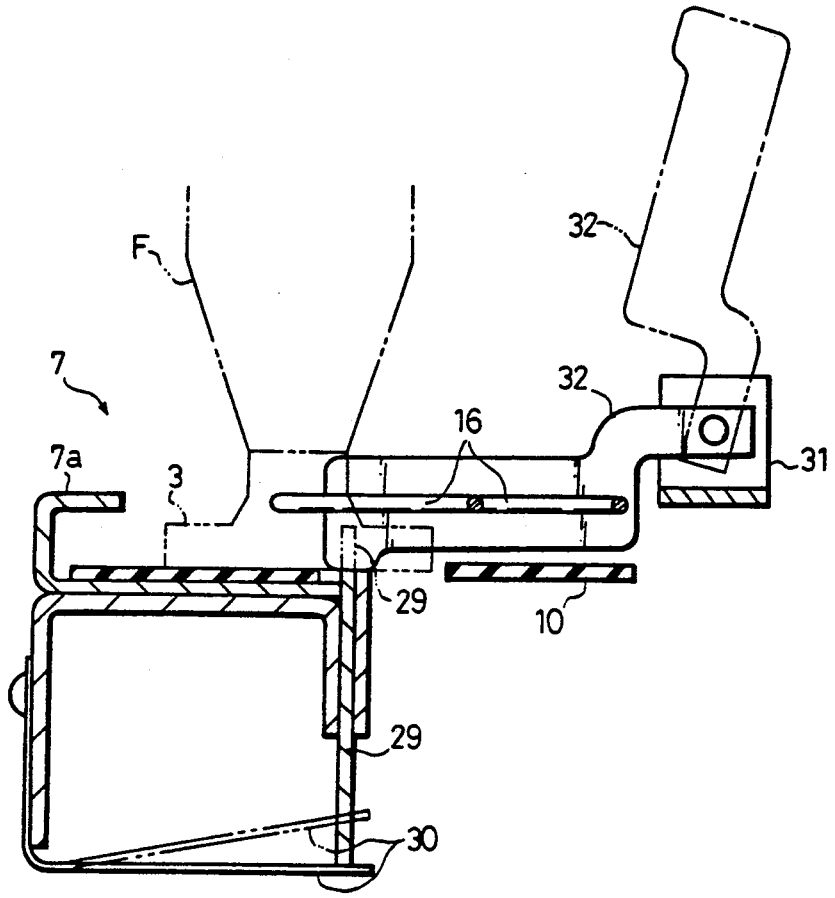

Next, a second embodiment will be described referring to FIGS. 7 to 9. In the embodiment, there is a large difference from the first embodiment in that one bobbin carrier 9 is used for a plurality of fine spinning machine frames 1 in common instead of arranging the bobbin carriers 9 at the fine spinning machine frame 1 for giving and receiving the full bobbins and the empty bobbins between the carriers 2*a*, 2*b* respectively arranged at the fine spinning machine frame 1 and the full-bobbin-carrying conveyor 7 and the empty-bobbin-carrying conveyor 8.

Figure 7:
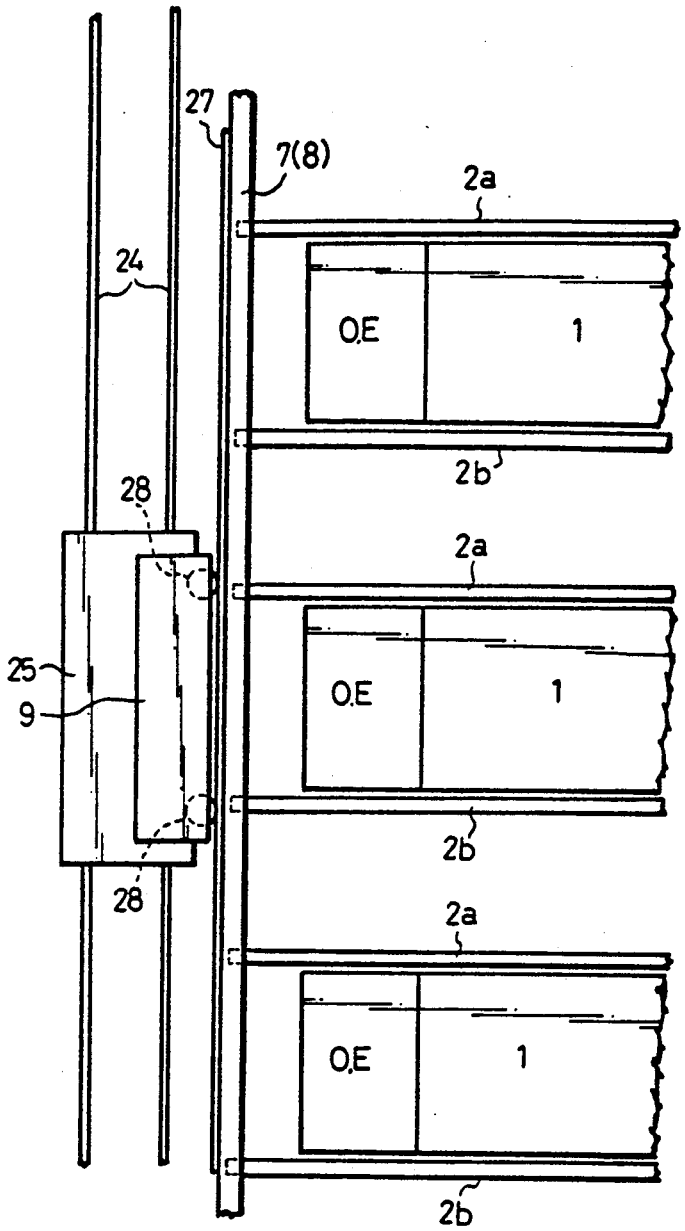
FIGS. 7 to 9 show a second embodiment of this invention.

As shown in FIG. 7, there are provided a pair of rails 24 extending perpendicularly to the longitudinal direction of the frames 1 which are disposed in parallel one another, and the bobbin carrier 9 having substantially the same composition as the above-mentioned bobbin carriers 9 is mounted on a car body 25 moving on the rails 24. In a frame (not shown) for supporting the bobbin carrier 9, there are provided engaging rollers 28 moving along a guiding rail 27 provided in parallel with and in the vicinity of an empty-bobbin-carrying conveyor 8. Thus, the bobbin carrier 9 can be moved along a full-bobbin-carrying conveyor 7 and the empty-bobbin-carrying conveyor 8 while keeping a predetermined interval from both of the bobbin-carrying conveyors 7, 8. Empty-bobbin-discharging portions 15 in the empty-bobbin-carrying conveyor 8 have substantially the same structures as those in the above-mentioned apparatus in the first embodiment. As shown in FIGS. 8 and 9, sides corresponding to the bobbin carriers 9 of guiding rails 7*a* of the full-bobbin conveyors 7 are notched to be opened to one sides at respective full-bobbin-introducing portions 14. In respective positions corresponding to the notched portions, controlling segments 29 are arranged slidably in the vertical direction, and usually the segments 29 are situated to positions as designated by a dotted line in FIG. 9 with the bottom ends thereof being in contact with plate springs 30 fixed at the guiding rail 7*a* so as to prevent the peg trays 3 from moving outside from the notched portions. At a place corresponding to the upper ends of guiding members 16, as a full-bobbin discharging portion of the bobbin carrier 9, a rotary solenoid 31 is fixed, and at the driving shaft of the solenoid 31 is fixed integrally and pivotably a controlling member 32 to be optionally arranged to a working position engageable with the peg trays 3 running on a belt 10 and the controlling segment 29 and to a retracted position not engageable therewith.

Hereinafter, operation of the apparatus composed in the manner as mentioned above will be described. After the machine's stopping with the bobbins fully wound and the exchange of the bobbins completed, the car body 25 is moved at a position corresponding to a fine spinning machine frame 1 by a work-requiring signal from the spinning machine for requiring the carrying out of the full bobbins F and the carrying in of the empty bobbins E. Then, the full-bobbin-discharging portion and the empty-bobbin-introducing portion of the bobbin carrier 9 mounted on the car body 25 are respectively positioned corresponding to the full-bobbin-introducing portion 14 of the full-bobbin-carrying conveyor 7 and the empty-bobbin-discharging portion 15 of the empty-bobbin-carrying conveyor 8. Thereafter, the rotary solenoids 22, 31 are operated to position the controlling segments 23, 32 at the working positions respectively, and then carriers 2*a*, 2*b* and the bobbin carrier 9 are operated in the same manner as mentioned above. Then, the full bobbins F on the carriers 2*a*, 2*b* are carried out on the full-bobbin-carrying conveyor 7 through the bobbin carrier 9, while the empty bobbins E on the empty-bobbin-carrying conveyor 8 are carried in on the carriers 2*a*, 2*b* through the bobbin carrier 9 in the same manner as mentioned above. By this embodiment, since the only one bobbin carrier 9 can be used in common for a plurality of the fine spinning machine frames 1, the cost of the equipment can be certainly reduced.

Figure 10:
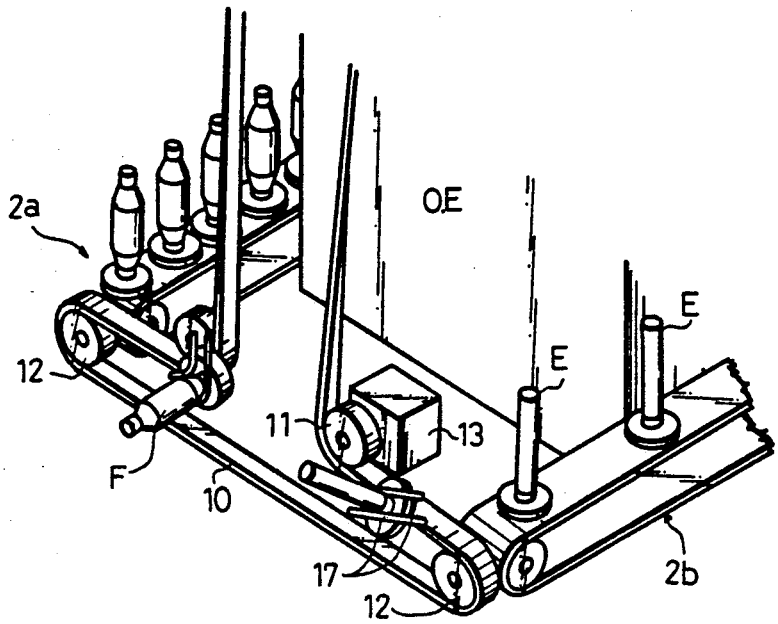
FIG. 10 shows a partly perspective view of a modified example.
Figure 13:
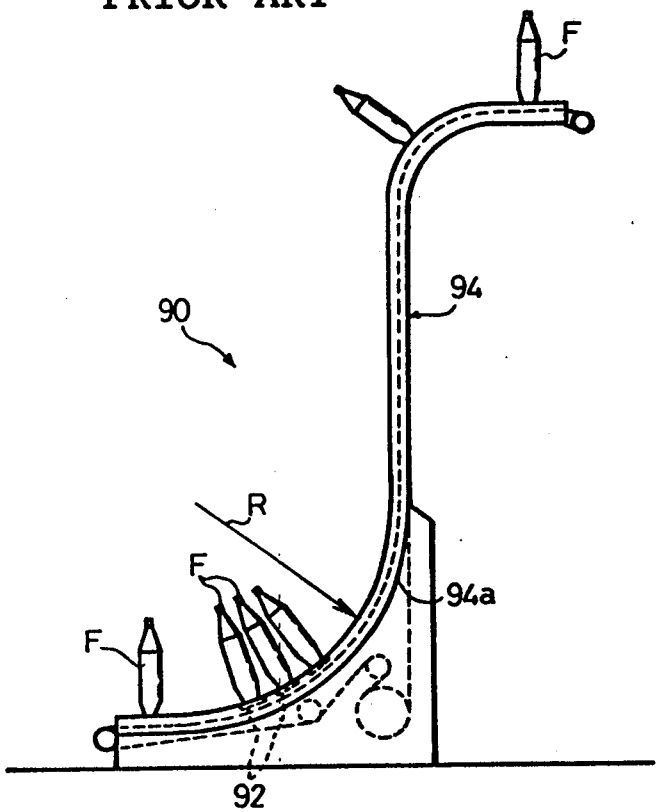
FIG. 13 PRIOR ART
FIG. 13 shows a side view of still another apparatus in the related art.
Figure 11:
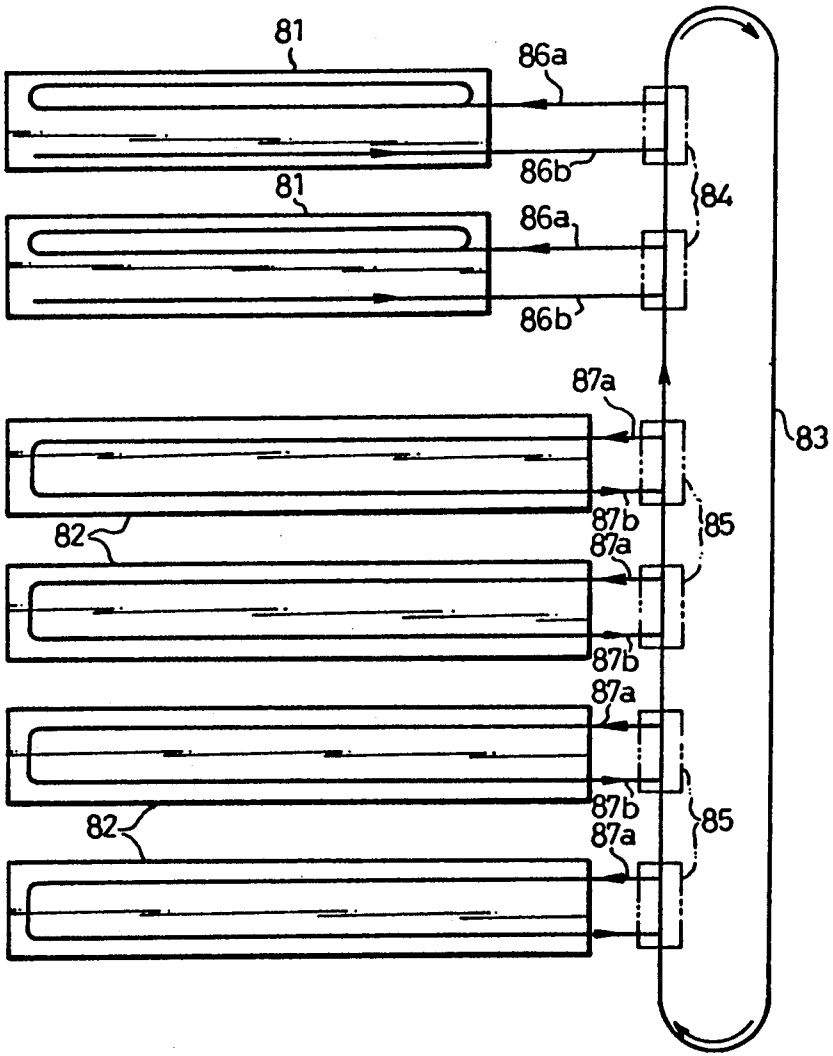
FIG. 11 PRIOR ART
FIG. 11 shows a schematic plan view of a bobbin carrier in the related art.
Figure 14:
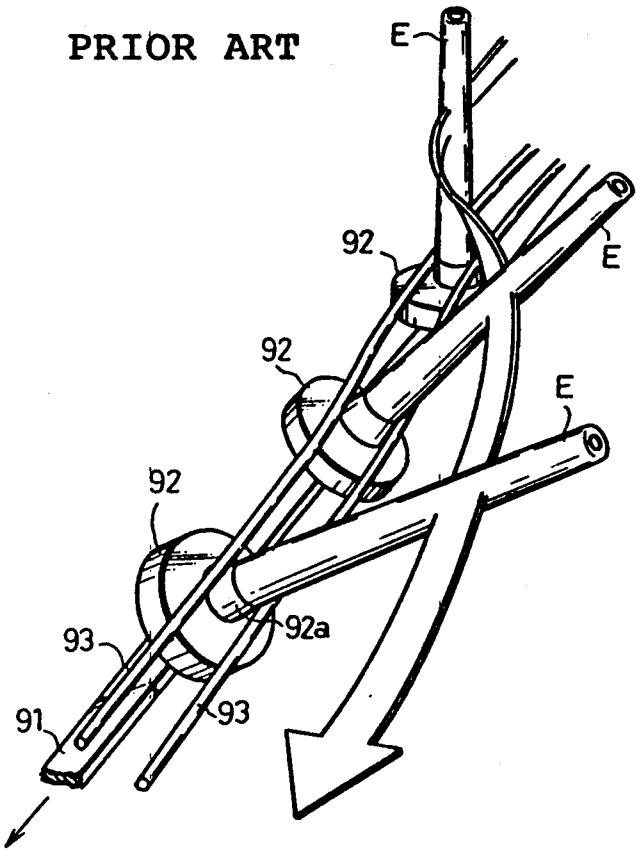
FIG. 14 PRIOR ART
FIG. 14 shows a perspective view of still another apparatus in the related art.
Figure 12:
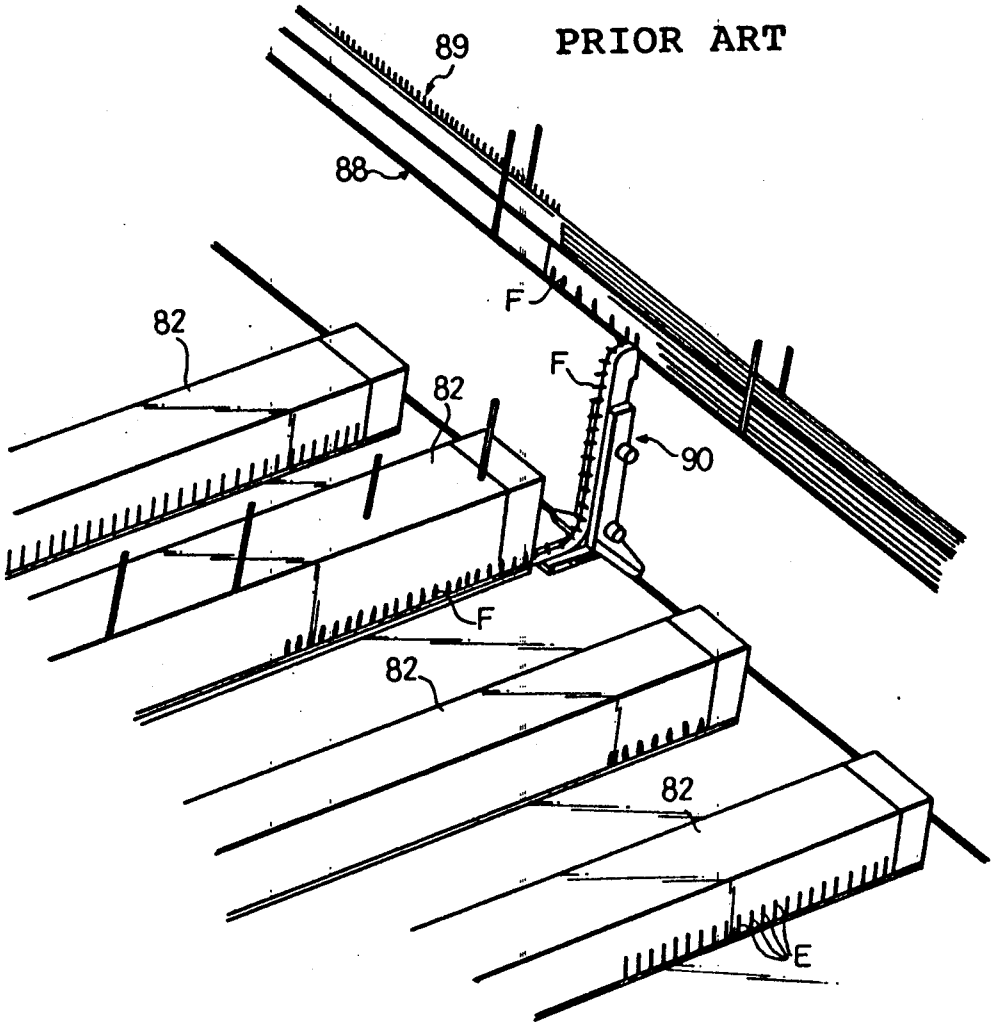
FIG. 12 PRIOR ART
FIG. 12 shows a schematic perspective view of another apparatus in the related art.

This invention is not limited to both the above-mentioned embodiments, and for example, the running state of the belt 10 of the bobbin carrier 9 in the portions corresponding to the carriers 2*a*, 2*b* may be so arranged that the belt 10 runs in a plane perpendicular to the carriers 2*a*, 2*b* as shown in FIG. 10, or the apparatus in the second embodiment may have a structure in which the controlling member 23 to be arranged at the corresponding position to the empty-bobbin-discharging portion 15 is instead arranged in common in the bobbin carrier 9. In the latter case, it is not necessary to provide the controlling members 23 respectively corresponding to the empty-bobbin-discharging portions 15. Moreover, the apparatus in the respective embodiments may have a structure in which the carriers *2a, 2b* respectively provided at both the sides of the fine spinning machine 1 are not connected with each other through the connecting rail 6 at the gear end GE side, but the belt conveyors 5 for the respective carriers *2a, 2b* are independently reciprocally movable. Additionally, the apparatus may be also applied to ring twisters other than the fine spinning machines.

It should be obviously understood that widely different embodiments can be composed without departing from the spirit and scope of the invention, thus the invention should not be limited in the specific embodiments except that it is limited only to the appended claims.

What is claimed is:

1. A bobbin carrier in a spinning machine for carrying out full bobbins from and carrying in empty bobbins to a respective carrier provided on each longitudinal side of the spinning machine, the bobbins being supported on peg trays having trays from which pegs project from a face of the tray, and the bobbins being delivered by the bobbin carrier to a full-bobbin-carrying conveyor and received by the bobbin carrier from an empty-bobbin-carrying conveyor which conveyors extend substantially perpendicularly to the longitudinal direction of the spinning machine in the vicinity of one end in the longitudinal direction of the spinning machine, characterized in that the bobbin carrier comprises an endless belt provided adjacent both the carriers and the conveyors, guiding means for guiding and supporting the belt, driving means operatively connected to the belt for driving the belt, a pair of linear guiding members disposed so as to extend along the belt for sandwiching the pegs of the peg trays, the belt carrying the peg trays while sandwiching the trays elastically with pressure in cooperation with the guiding members, a full-bobbin introducing portion provided in the full-bobbin-carrying conveyor where delivering and receiving of the peg trays from the belt to the full-bobbin-carrying conveyor can occur, an empty-bobbin-discharging portion provided in the empty-bobbin-carrying conveyor where delivering and receiving of the peg trays from the empty-bobbin-carrying conveyor to the belt can occur, and a controlling member provided at the empty-bobbin-discharging portion and movable between a working position where it can engage the peg trays on the empty-bobbin-carrying conveyor and a waiting position not engageable therewith, the controlling member when in the working position controlling the moving direction of the peg trays to cause passage of the peg trays from the empty-bobbin-carrying conveyor to the belt.

2. A bobbin carrier according to claim 1, wherein the bobbin carrier further comprises a guiding rail provided at the empty-bobbin-carrying conveyor for guiding the peg trays being carried on the empty-bobbin-carrying conveyor, and the empty-bobbin-discharging portion comprises a notched portion formed in a portion of the guiding rail opposite the belt.

3. A bobbin carrier according to claim 2, wherein the bobbin carrier further comprises a controlling segment, provided at the notched portion, which is able to open and close the notched portion, and an urging means connected to the controlling segment for urging the controlling segment, and the controlling segment opens the notched portion at the working position of the controlling member, and the controlling segment closes the notched portion at the waiting position of the controlling member.

4. A bobbin carrier according to claim 3, wherein the controlling member and the controlling segment are operatively connected to each other, and the controlling segment opens the notched portion by the operation of the controlling member at the working position, and the controlling segment closes the notched portion by the operation of the controlling member at the waiting position.

5. A bobbin carrier according to claim 1, wherein there are additional spinning machines and the bobbin carrier includes means for moving it from the one end of the spinning machine to a corresponding position at each additional spinning machine so as to carry out and carry in the bobbins therefor.

6. A bobbin carrier according to claim 5, wherein the means for moving the bobbin carrier comprises rails perpendicularly extending to the longitudinal direction of the spinning machine at the one end in the longitudinal direction of the spinning machines, and a car body supported on the rails for supporting the bobbin carrier.

7. A bobbin carrier in a spinning machine for carrying out full bobbins from and carrying in empty bobbins to a respective carrier provided on each longitudinal side of the spinning machine, the bobbins being supported on peg trays having trays from which pegs project from a face of the tray, and the bobbins being delivered by the bobbin carrier to a full-bobbin-carrying conveyor and received by the bobbin carrier from an empty-bobbin-carrying conveyor which conveyors extend substantially perpendicularly to the longitudinal direction of the spinning machine in the vicinity of one end in the longitudinal direction of the spinning machine, characterized in that the bobbin carrier comprises an endless belt provided adjacent both the carriers and the conveyors, guiding means for guiding and supporting the belt, driving means operatively connected to the belt for driving the belt, a pair of linear guiding members disposed so as to extend along the belt for sandwiching the pegs of the peg trays, the belt carrying the peg trays while sandwiching the trays elastically with pressure in cooperation with the guiding members, a full-bobbin introducing portion provided in the full-bobbin-carrying conveyor where delivering and receiving of the peg trays from the belt to the full-bobbin-carrying conveyor can occur, an empty-bobbin-discharging portion provided in the empty-bobbin-carrying conveyor where delivering and receiving of the peg trays from the empty-bobbin-carrying conveyor to the belt can occur, a guiding rail provided at the full-bobbin-carrying conveyor for guiding the peg trays being carried on the full-bobbin-carrying conveyor, and the full-bobbin-introducing portion comprises a notched portion formed in a portion of the guiding rail opposite the belt.

8. A bobbin carrier according to claim 7, wherein the guiding member extends above the full-bobbin-carrying conveyor through the notched portion.

9. A bobbin carrier according to claim 7, wherein there are additional spinning machines and the bobbin carrier includes means for moving it from the one end of the spinning machine to a corresponding position at each additional spinning machine so as to carry out and carry in the bobbins therefor.

10. A bobbin carrier according to claim 9, wherein the means for moving the bobbin carrier comprises rails perpendicularly extending to the longitudinal direction of the spinning machines at the one end in the longitudinal direction of the spinning machines, and a car body supported on the rails for supporting the bobbin carrier.

* * * * *